United States Patent [19]

Culpepper

[11] 4,188,766

[45] Feb. 19, 1980

[54] PACKAGING MACHINE

[75] Inventor: Will L. Culpepper, Tucker, Ga.

[73] Assignee: The Mead Corporation, Dayton, Ohio

[21] Appl. No.: 963,004

[22] Filed: Nov. 22, 1978

[51] Int. Cl.[2] ..... B65B 21/00

[52] U.S. Cl. ..... 53/49; 53/48

[58] Field of Search ..... 53/49, 48

[56] References Cited

U.S. PATENT DOCUMENTS

| | | | |
|---|---|---|---|
| 3,302,364 | 2/1967 | Rice | 53/48 X |
| 3,760,554 | 9/1973 | Arneson | 53/49 X |

*Primary Examiner*—Travis S. McGehee

*Attorney, Agent, or Firm*—Walter M. Rodgers; Walter A. Rodgers

[57] ABSTRACT

A machine for packaging a plurality of bottles by enveloping the bottle necks within a plurality of apertures (2–7) formed in a main panel (1) of a carrier blank includes means for moving a group of bottles along a predetermined path (85,87), means for moving a carrier blank above the bottles and in synchronism therewith and with the apertures (b 2–7) in the main panel (1) of the blank disposed in vertical coincidence with the bottle necks, static plows (81,82) arranged to engage the main panel (1) from above and to urge it downwardly so that the apertures in the main panel engage the bottle necks together with a rotatable element (93) which engages a longitudinal fold line (8) formed in the main panel (1) of the blank and disposed in alignment with the apertures to facilitate envelopment of the bottle necks together with plow means (96,97,98,99,100) arranged to engage and fold the extensions of the blank which are foldably joined to the side edges of the main panel upwardly and over the tops of the packaged bottles and downwardly into overlapping face contacting relation with the main panel (1) together with a rotatable member (102) for engaging the topmost end portion of the blank so as to facilitate insertion of holding tabs (58–61) formed along the end edge thereof into holding apertures (37–40) formed in the other blank extension (26).

8 Claims, 8 Drawing Figures

PACKAGING MACHINE

TECHNICAL FIELD

This invention is applicable to bottle carriers of the so-called top gripping type and concerns a machine for manipulating a carrier blank into set-up condition and simultaneously for applying the blank to a group of bottles.

BACKGROUND ART

Known machines for manipulating a carrier blank of the type to which the machine of this invention is applicable include reciprocatory mechanism for engaging a blank and for driving it downwardly so that apertures formed in the blank envelope the necks of bottles disposed therebelow and also include means for arresting the movement of a bottle group and its associated blank during a packaging operation. U.S. Pat. No. 3,302,364 issued Feb. 7, 1967 is representative of the above described known prior art.

DISCLOSURE OF INVENTION

This invention is one form comprises means for moving a group of bottles along a predetermined path and for moving a carton blank along such path and immediately above the group of bottles and in synchronism therewith, static plows for engaging the carrier blank from above and for urging it down so that apertures formed in its main panel envelope the necks of the bottles disposed therebelow while a rotatable element simultaneously engages the blank at predetermined parts thereof and facilitates manipulation of the blank, static plows for manipulating extensions of the blank upwardly, inwardly, and downwardly so that the blank envelopes the caps of the bottles, and a rotatable member for engaging one end portion of the blank which is disposed above the other end portion to drive tabs formed in the upper end portion downwardly through apertures formed in the main panel of the blank and simultaneously to facilitate the insertion of holding tabs formed along one end edge of the blank into holding apertures formed in the opposite extension thereof.

BRIEF DESCRIPTION OF THE DRAWINGS

In the drawings

FIG. 4 is a view of one side of a rotatable member used in performing the final locking operation of the carrier and in which

BEST MODE FOR CARRYING OUT THE INVENTION

The carrier to which the machine of this invention is particularly applicable is disclosed and claimed in U.S. patent application Ser. No. 962,611 filed Nov. 21, 1978. In order to facilitate an understanding of the machine of this invention, a brief description of the carrier of U.S. application Ser. No. 962,611 is here included.

Figure 1:
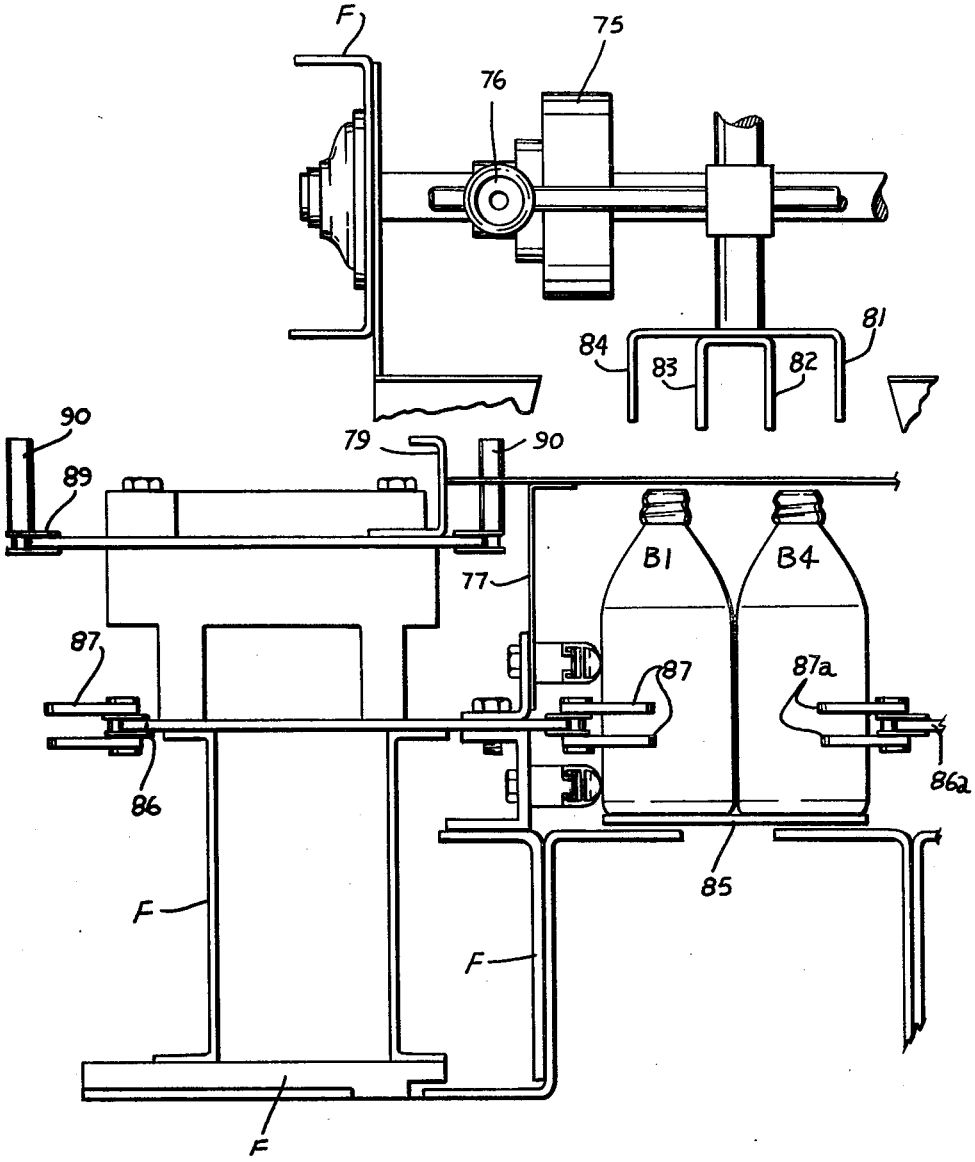
FIG. 1 is an end view of one side of the infeed end of a machine formed according to this invention.
Figure 1A:
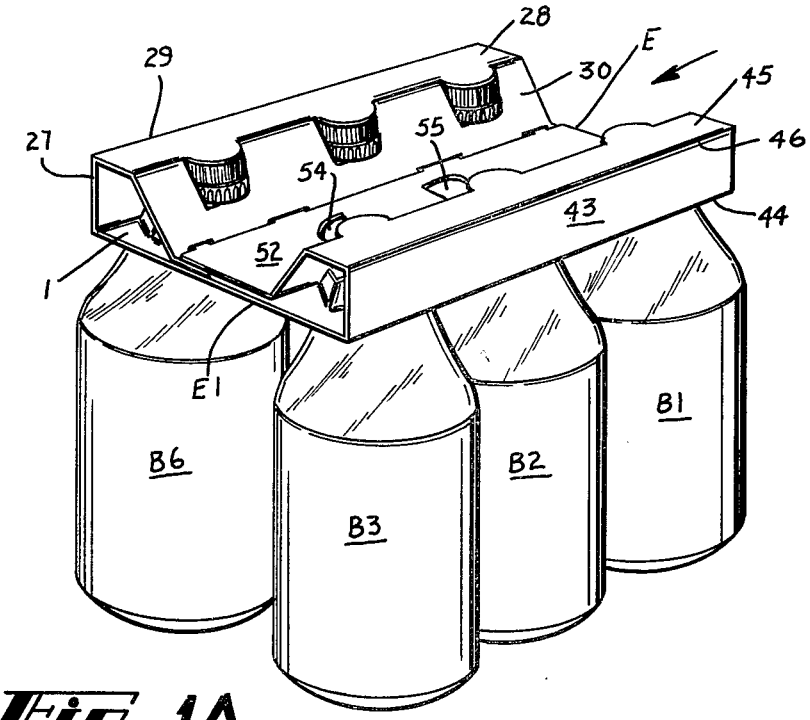
FIG. 1A is a perspective view of a finished package formed by a machine constructed according to this invention.
Figure 1B:
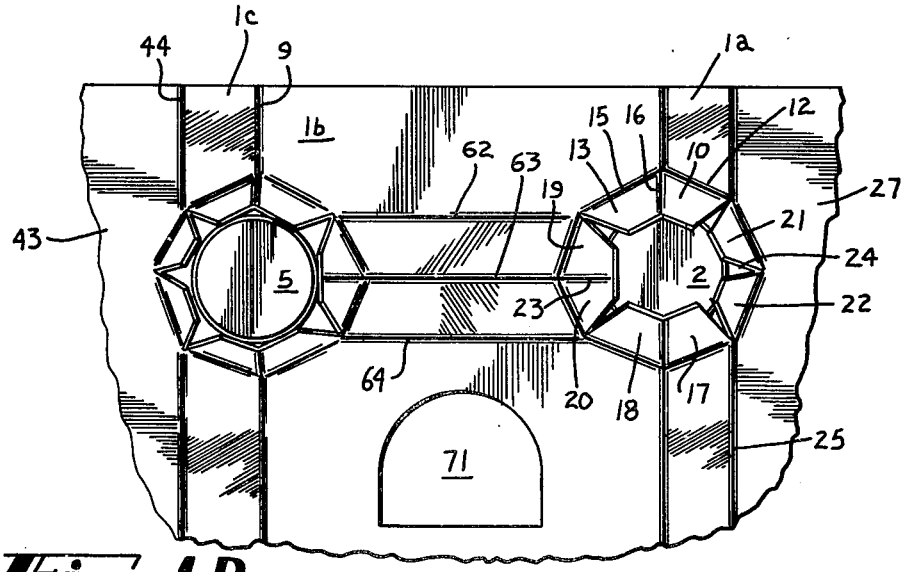
FIG. 1B is an enlarged fragmentary view of a portion of a blank used in forming the package of FIG. 1A.
Figure 1C:
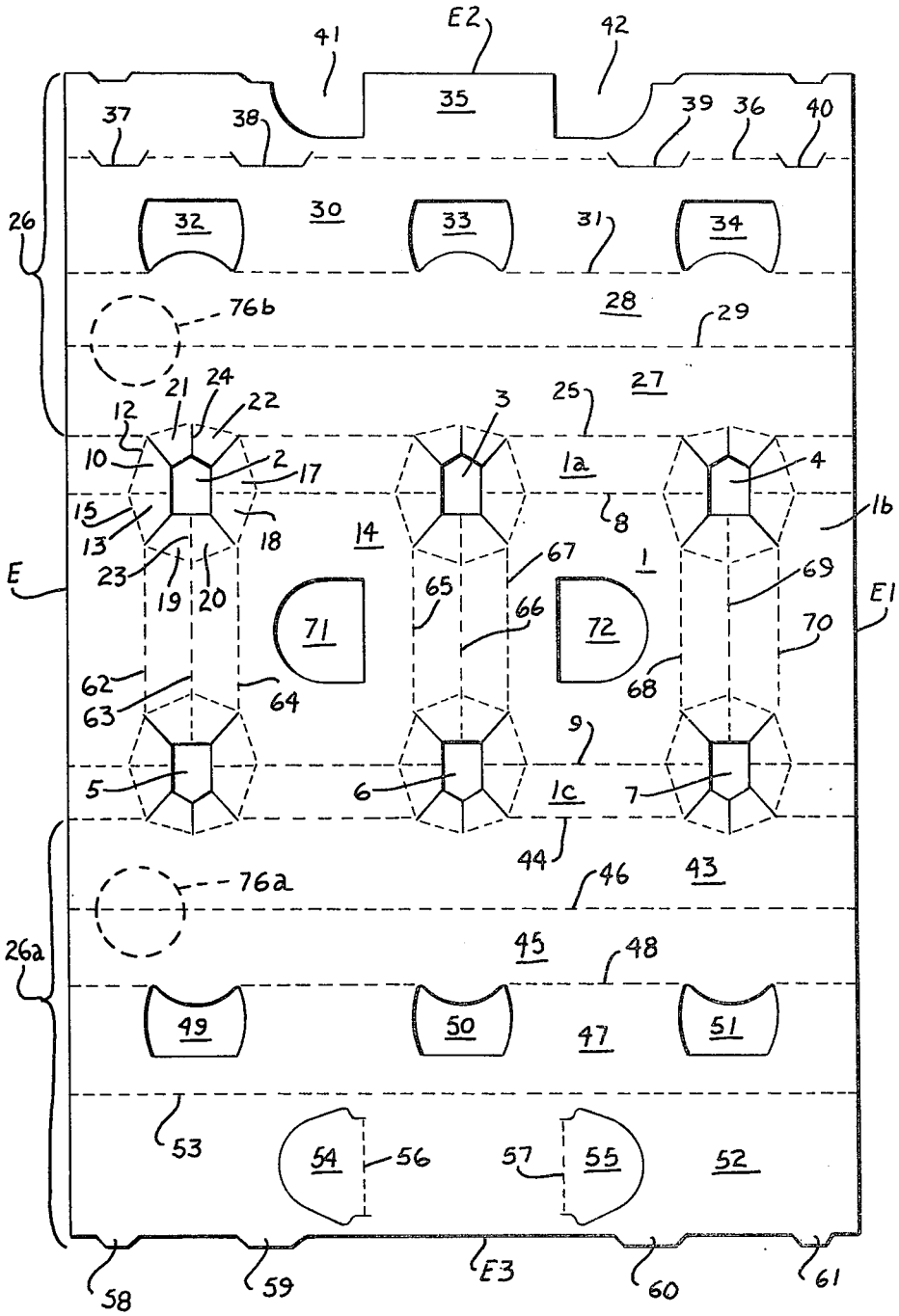
FIG. 1C is a plan view of the blank used in forming the package depicted in FIG. 1A.

With reference to FIGS. 1A, 1B and 1C, the numeral 1 designates the main panel of the carton while the numerals 2–7 inclusive designate apertures formed in the main panel 1. Apertures 2–4 are disposed along the longitudinal fold line 8 while apertures 5, 6 and 7 are disposed along the longitudinal fold line 9. Longitudinal fold line 8 separates panel sections 1*a* and 1*b* while fold line 9 is the junction between panel sections 1*b* and 1*c*. All of the apertures 2–7 are of the so-called sunburst construction and include supporting tabs. Only one aperture such as 2 and its associated structure is here described in detail since all of the apertures are identical.

With reference to FIG. 1B, support tab 10 is foldably joined to panel section 1*a* along fold line 12 while support tab 13 is foldably joined to panel section 14 along fold line 15. From FIGS. 1B and 1C it is apparent that fold lines 12 and 15 diverge from each other in the direction of aperture 2. Furthermore support tabs 10 and 13 are foldably joined to each other along fold line 16. Support tabs 17 and 18 are similar to tabs 10 and 13 both in structure and orientation and a detailed description thereof is not deemed necessary. Similarly support tabs 19 and 20, 21 and 22 are of similar construction although it should be pointed out that tabs 19 and 20 are interconnected by fold line 23 while tabs 21 and 22 are separated by a slit 24.

Foldably joined to the side edge 25 of main panel 1 is a panel extension designated by the numeral 26. Panel extension 26 includes a side wall 27 foldably joined to main panel 1 along fold line 25 together with a top wall 28 foldably joined along the upper edge of side wall 27 along fold line 29. Intermediate panel 30 is foldably joined to top wall 28 along fold line 31 and includes apertures 32, 33, 34 and end portion 35 is foldably joined to intermediate panel 30 along fold line 36 and includes holding apertures 37, 38, 39, and 40. Cutaway areas or notches 41 and 42 are also provided in end portion 35.

At the other end of the blank as shown in FIG. 1C, extension 26*a* begins at fold line 44 and extends to the end of the blank and includes similar elements to extension 26. Side wall 43 is foldably joined to main panel 1 along fold line 44 while top wall 45 is foldably joined to the top edge of side wall 43 along fold line 46. Intermediate panel 47 is foldably joined to top wall panel 45 along fold line 48 and includes apertures 49, 50, and 51. End portion 52 is foldably joined to intermediate panel 47 along fold line 53 and includes finger gripping tabs 54 and 55 which are foldably joined to end portion 52 along fold lines 56 and 57 respectively. Holding tabs 58, 59, 60, and 61 are formed along the end edge of end portion 52.

For facilitating manipulation of the blank during a packaging operation, transverse score lines 62–70 are formed in main panel 1 and for receiving the finger gripping tabs 54 and 55, a pair of locking apertures 71 and 72 are formed in main panel 1 as will be more fully understood as the description proceeds.

With a group of bottles assembled in a rectilinear arrangement and with the carrier disposed above a group of bottles, the carrier is lowered so that the six bottle necks enter the apertures 2–7 respectively and thereafter extensions 26 and 26*a* are elevated, folded inwardly and downwardly in such fashion that the end portion 52 of extension 26*a* overlies end portion 35 of extension 26 and locking tabs 54 and 55 are driven through the cutaway areas 41 and 42 respectively of end portion 35 and locking tabs are simultaneously driven through the locking apertures 71 and 72 respectively to complete the carrier in set-up condition as shown in FIG. 1A. The bottles and carrier move continuously while the above manipulations are performed.

With reference to FIGS. 1–5 inclusive, the numeral 75 generally designates a suction cup type feeder having suction cups 76 and which is of conventional known construction and which is arranged to withdraw a carrier blank from a hopper not shown in the drawings and then to deposit such carrier atop support guides 77 and 78. The carrier is oriented so that its edge E is in leading relation while its edge E1 as indicated in FIG. 1C is in trailing relation. Thus as viewed from above and as seen in FIG. 1C, the edge E2 is on the rear side of FIG. 2 while the edge E3 is on the far or upper side of FIG. 2. The suction cups designated by the numeral 76 engage the blank as shown in FIG. 1C at the dotted circles 76*a* and 76*b*. Edge E3 of the blank is guided from left to right by fixed side guide 79 and the opposite edge E2 is guided by side guide 80.

For driving the blank downwardly to cause the apertures in the main panel 1 to envelope the bottles, a first pair of static plows 81 and 82 are disposed above the row of bottles B4, B5 and B6 while a second pair of static plows 83 and 84 are disposed above the row of bottles B1–B3. As is best shown in FIG. 3, the bottom surfaces of these guides are curved downwardly so that engagement with these guides forces the main panel 1 of the blank downwardly and causes the apertures to envelope the bottles as is obvious as the bottles and blank move from left to right.

Figure 2:
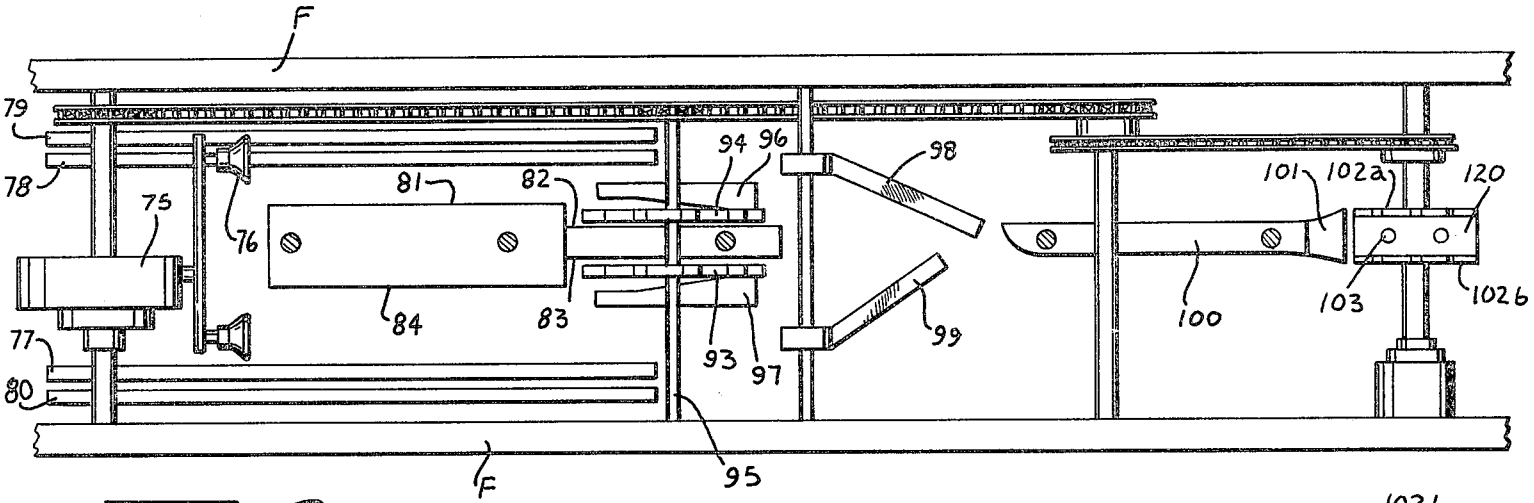
FIG. 2 is a plan view of a machine formed according to this invention.
Figure 3:
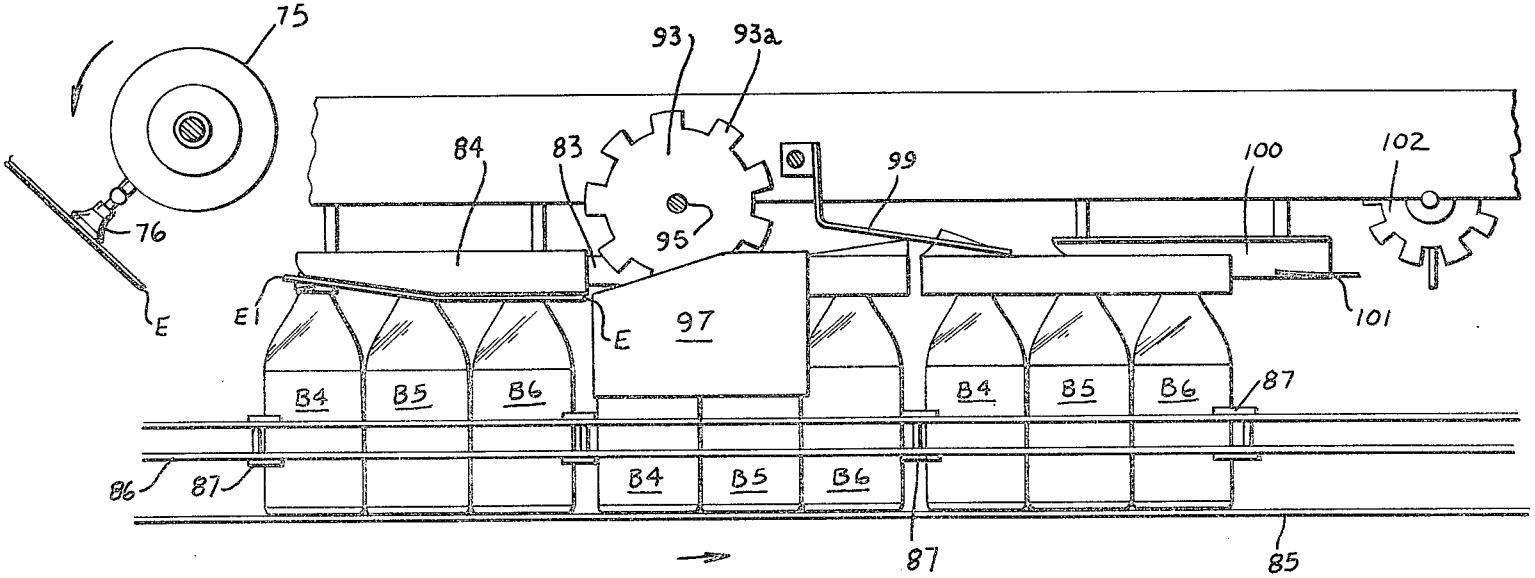
FIG. 3 is a side view of the mechanism shown in FIG. 2.

Of course this packaging operation is dependent upon synchronous movement of the bottles and of the wrapper and such movement is effected by conveyor means 85 which is of conventional construction and the working reach of which moves from left to right as viewed in FIGS. 2 and 3 and which is assisted by horizontally disposed synchronously driven chain 86 and its associated lugs 87 which as is apparent from FIG. 3 enter and are disposed between adjacent groups of three bottles in a row for controlling the movement of the group along conveyor means 85. It is apparent from FIG. 1 which emphasizes the left hand portion of the infeed end of the machine, a similar chain 86*a* and lugs 87*a* is disposed on the opposite side of the machine. Simultaneously the blank is moved in synchronism and at the same speed as the bottles by means of horizontally disposed chain 89 arranged in spaced relationship above chain 86 and on which a plurality of pusher elements 90 are mounted. While not shown in the drawings a chain and lugs similar to 89 and 90 are disposed on the right hand part of FIG. 1.

In order to insure that the support tabs such as 10, 13, 17, and 18 may move upwardly as the carton blank is moved downwardly, the longitudinal fold lines 8 and 9 are provided and are aligned with the apertures 2–4 and 5–7 respectively and rotatable elements 93 and 94 are mounted on a shaft 95 secured to the frame F of the machine and are driven in synchronism with the bottles and blank. As is best shown in FIGS. 2 and 3, these elements 93 and 94 include spokes 93*a* and 94*a* which straddle apertures 2–7 and engage the fold lines 8 and 9 at points intermediate the apertures 2–7 inclusive. The spokes also engage these fold lines 8 and 9 on those portions of these fold lines between apertures 2 and 5 and the edge E and those portions of these fold lines which are located between apertures 4 and 7 and edge E1. The engagement of succeeding blanks is so that the trailing edge of a particular blank is engaged by the same spoke of elements 93 and 94 as is the leading edge of a succeeding blank as will be readily understood. This downward folding by the rotatable elements 93 and 94 divides the main panel 1 into panel sections of which 1*a* constitutes that portion of the panel between fold line 8 and fold line 25 and another of which 1*c* comprises that portion of main panel 1 which is disposed between fold lines 9 and 44 while a third panel section 1*b* comprises the central portion of the blank disposed between the longitudinal fold lines 8 and 9. The action of these rotatable elements 93 and 94 is simply to depress the blank along the fold lines 8 and 9 and thus to facilitate upward folding of the support tabs when the blank is applied to the necks of the bottles and such folding is desirable due to the fact that the fold lines such as 12 and 15 of the tabs 10 and 13 diverge with respect to each other in the direction of the aperture 2. Thus downward folding of the fold line 8 facilitates upward folding of the tabs such as 10 and 13 and also urges the tabs 21 and 22 toward the neck of the bottle in aperture 2 and insures that the tabs engage the bottle neck under the bottle cap.

For manipulating the extensions of the blank such as those designated in FIG. 1C by the numeral 26 and 26*a* upwardly, a third pair of plows are employed and in the drawings are designated by the numerals 96 and 97 so that when the carton clears the right hand ends of these plows the blank extensions are substantially vertically disposed.

For folding those portions of the blank extensions which are between the upper edges 29 and 46 of the side walls 27 and 43 and the associated end portions of the blank into overlying relation with respect to the bottles in the two rows, fixed rod plows 98 and 99 are employed and constitute a fourth pair of plows which fold those portions of the blank between fold line 29 and edge E2 and between fold line 46 and edge E3 into substantially horizontal positions. This folding operation is such that the end portion 35 is disposed underneath the end portion 52 as is apparent from the drawings.

In order to fold the intermediate panels 30 and 47 into angular downwardly inclined disposition relative to their associated top wall panels 28 and 45 and also to cause the end portion 35 to fold into flat face contacting relation with main panel 1 and below the end portion 52, a fifth plow 100 is employed. This plow of course engages the upper panel 52 and a dovetailed supplementary plow 101 forces the panel 52 downwardly into close contact with the end portion 35.

Figure 5:
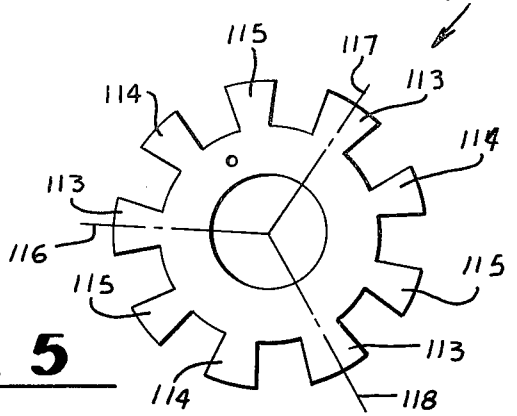
FIG. 5 is a view similar to FIG. 4 but which is taken from the opposite side of the rotatable member shown in FIG. 4.
Figure 4:
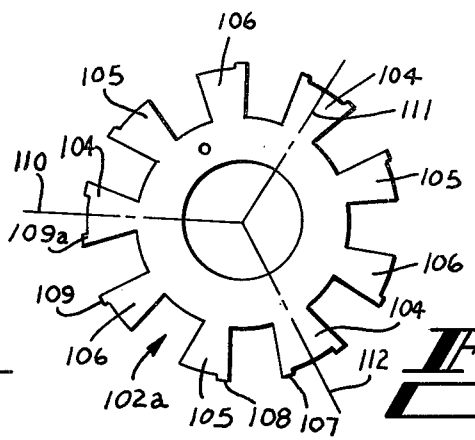

For the purpose of driving the locking tabs 54 and 55 through the notches 41 and 42 and the locking apertures 71 and 72, a rotatable member 102 is employed and is provided with radially disposed fingers 103 which are arranged so as to engage the locking tabs 54 and 55 and to drive these into locking position as is obvious. The rotatable member 102 also serves to facilitate slight downward movement of end portions 35 and 52 and thus tends to open the holding apertures 37, 38, 39, and 40. The rotatable member 102 comprises a pair of units such as are indicated in FIGS. 4 and 5. The unit 102*a* in FIG. 4 includes radial segments 104, 105, 106, and these segments are provided with protruding tabs 107, 108, 109, and 109*a*. These tabs engage the holding tabs 58–61 respectively and drive these elements firmly into the apertures 37–40 respectively. The segmental imaginary lines 110, 111, and 112 are shown in FIG. 4 simply indicate that the rotatable member 102*a* makes one revolution for three series of three bottles arranged in a single row and is chosen for mechanical reasons.

The rotatable element 102 also includes the unit 102*b* of FIG. 5 which includes imaginary lines 116, 117, and 118 which correspond with imaginary lines 110, 111, and 112 respectively so that when these two rotatable members of FIGS. 4 and 5 are assembled together with their imaginary lines in coincidence and with a central spacer cylinder 120 disposed therebetween the unit serves to spread the intermediate lower edges of the intermediate panels 30 and 47 apart somewhat during the time when the holding tabs 58–61 are being inserted into the holding apertures 37–40. When the locking operation is complete and the carton moves out from under the rotatable member 102, the "fight" of the material from which the carton is formed and the relaxation of pressure from rotatable member 102 combine to allow the holding tabs to remain firmly and securely inserted within their associated holding apertures.

INDUSTRIAL APPLICABILITY

A machine constructed according to this invention is well suited for use in conjunction with top gripping carriers of the type which are manipulated into assembled condition and simultaneously applied to groups of continuously moving bottles in a bottler's plant and thus provides an efficient and economical packaging procedure.

I claim:

1. A machine for applying a carrier blank to a plurality of bottles said blank having a main panel (1) in which a longitudinal fold line (8) is formed to define a pair of panel sections (1*a*,1*b*) and in which a plurality of spaced apertures (2–4) are formed along said fold line and with a plurality of support tabs (10,21,22,17) (13,19,20,18) foldably joined to each of said panel sections and with the free end of each tab defining an edge portion of one of said apertures and certain adjacent tabs being foldably joined to different panel sections along angularly related fold lines (12,15) which diverge toward the associated aperture (2) and said adjacent tabs being interconnected along their adjacent edges, said machine comprising means (85,87) for moving a row of aligned bottles along a predetermined path, means for moving a carrier blank in synchronism with said bottles and with the apertures therein disposed above and in coincidental relation with said bottles respectively, a pair of static plows (81,82) disposed above and in straddling relation to said row of bottles for moving the carrier downwardly so that the apertures therein envelope the necks of the bottles respectively, and a rotatable element (93) having a plurality of radially arranged spokes (93*a*) disposed above the carrier blank and arranged so that each spoke engages said longitudinal fold line (8) thereby to deflect said panel sections downwardly toward each other and to facilitate upward folding of said support tabs.

2. A machine according to claim 1 wherein said carrier blank includes a second longitudinal fold line (9) with similar associated apertures (5–7) and support tabs all arranged to envelope the necks of a second parallel row of bottles and wherein said machine includes a second pair of static plows (83,84) disposed above and in straddling relation to said second row of bottles for engaging the blank on opposite sides of said second longitudinal fold line so as to cause the associated apertures to envelope the respective bottle necks in said second row of bottles, and a second rotatable element (94) having a plurality of radially arranged spokes (94*a*) disposed above the carrier and engageable with said second longitudinal fold line (9) to facilitate upward folding of the associated support tabs.

3. A machine according to claim 2 wherein the carrier blank includes a pair of extensions (26,26*a*) foldably joined to the side edges (25,44) respectively of said main panel (1) and wherein a third pair of static plows (93,94) are arranged to engage and fold said extensions respectively upwardly, and wherein a fourth pair of static plows (98,99) respectively engage and fold said extensions inwardly and over the tops of the bottles in both rows of bottles with an end portion 52 of one of said extensions overlying an end portion 35 of the other.

4. A machine according to claim 3 wherein a fifth static plow (100) is arranged to engage the upper one of said extensions to fold both extensions downwardly and between the two rows of bottles.

5. A machine according to claim 4 wherein the carrier main panel (1) includes a pair of finger gripping apertures (71,72) and said one extension includes a pair of cushioning tabs (54,55) struck therefrom and in vertical coincidence with said finger gripping apertures (71,72) and wherein said machine includes a rotatable member (102) having radial fingers (103) for engaging said cushioning tabs and for driving said tabs through said finger gripping apertures respectively.

6. A machine according to claim 5 wherein said one carrier blank extension includes a plurality of holding tabs (58–61) projecting from its outer edge and wherein the other extensions of the blank includes holding apertures (37–40) and wherein said rotatable member (102) engages said one extension in such manner as to insert said holding tabs into said holding apertures respectively.

7. A machine according to claim 6 wherein said carrier blank extensions (26,26*a*) include end portions (35,52) adapted for assembly in flat face contacting relation and wherein said blank extensions also include intermediate panels (30,47) which when assembled are disposed in downwardly inclined angular relation to said end portions and wherein said rotatable member (102) includes laterally spaced units (102*a*,102*b*) for engaging said intermediate panels so as to move such panels apart a slight distance and to facilitate insertion of said holding tabs into said holding apertures.

8. A machine according to claim 7 wherein said rotatable element (102) also engages the upper one of said blank end portions and moves said end portions (35,52) downwardly somewhat to facilitate insertion of said holding tabs (58–61) into said holding apertures (37–40) respectively.

* * * * *